United States Patent [19]

Dwyer et al.

[11] 4,120,616

[45] Oct. 17, 1978

[54] VACUUM CLEANER-BLOWER ASSEMBLY WITH SOUND ABSORBING ARRANGEMENT

[75] Inventors: Niles M. Dwyer, Park Ridge; Janis A. Rasins, Chicago, both of Ill.

[73] Assignee: Breuer Electric Manufacturing Company, Chicago, Ill.

[21] Appl. No.: 619,790

[22] Filed: Oct. 6, 1975

[51] Int. Cl.[2] ..... F04B 35/04; F04B 39/06; F04D 29/44

[52] U.S. Cl. ..... 417/373; 417/423 A; 415/119; 415/191; 415/206; 310/63

[58] Field of Search ..... 417/368, 373, 312, 423 A, 417/424; 310/63; 415/183, 206, 119, 204, 159, 185, 161, 163, 191; 15/412, 413

[56] References Cited

U.S. PATENT DOCUMENTS

| | | | |
|---|---|---|---|
| 436,291 | 9/1890 | Patrick | 415/161 |
| 1,476,776 | 12/1923 | Stamm et al. | 310/63 |
| 1,843,088 | 1/1932 | Minnard | 415/204 |
| 1,978,129 | 10/1934 | Downs | 415/163 |
| 2,166,276 | 7/1939 | Anderson | 415/183 |
| 2,272,985 | 2/1942 | Smith | 417/423 A |
| 2,306,742 | 12/1942 | Moody | 415/183 |
| 2,465,625 | 3/1949 | Aue | 415/204 |
| 2,693,312 | 11/1954 | Lanter | 417/423 A |
| 2,731,194 | 1/1956 | Kent | 417/312 |
| 2,733,853 | 2/1956 | Trumpler | 415/161 |
| 2,767,904 | 10/1956 | Doyle | 417/423 A |
| 2,915,237 | 12/1959 | Galiuio et al. | 417/366 |
| 2,925,952 | 2/1960 | Garve | 415/183 |
| 3,060,335 | 10/1962 | Greenwald | 417/368 |
| 3,765,505 | 10/1973 | Pendleton | 417/312 |

FOREIGN PATENT DOCUMENTS

| | | | |
|---|---|---|---|
| 208,660 | 3/1966 | Sweden | 417/368 |

*Primary Examiner*—Carlton R. Croyle
*Assistant Examiner*—Thomas I. Ross
*Attorney, Agent, or Firm*—Gary, Juettner & Pyle

[57] ABSTRACT

A quiet and powerful vacuum cleaner-blower assembly comprises an improved quiet operating electric motor coupled to and driving an improved quiet operating blower. The motor has improved cooling air flow with cooling air inlet and discharge openings disposed to minimize noise. An axial flow cooling air fan impinges the cooling air onto sound absorbing material before discharging the cooling air from the motor. The blower has a high efficiency impeller utilizing forward and backward curved vanes which discharge air into a casing having a chamber with a cross-sectional flow area which linearly increases as air moves around the periphery, resulting in quiet operation and increased capacity with a less than expected increase in power consumption. The vacuum cleaner-blower assembly may be operated in conjunction with stationary guide blades for improving the flow of air into the impeller, resulting in still further increase in capacity without substantial increase in noise or power consumption.

7 Claims, 5 Drawing Figures

11
58
82
84
22
66
72
72
74
78
94
76
24
10
70
18
16
20
64
68
92
56
30
26
34
86
88
54
28
116
44
90
36
60
32
110
40
41
4.
96
46
4.
105
50
100
42
48
52
105
108
119
3.
3.
102
108
104
101
101
112
12
62
14
114
106
124
126
128
125
130
130
129
136
5.
5.
132
134
123
134

VACUUM CLEANER-BLOWER ASSEMBLY WITH SOUND ABSORBING ARRANGEMENT

BACKGROUND

Heretofore, vacuum cleaner-blower units, particularly of the smaller, inexpensive commercial type under 5 horsepower, suitable for portable or semi-portable use by an operator, were a compromise. Either they developed adequate vacuum or pressure (depending upon use as a vacuum cleaner or blower) at the expense of generating considerable noise, to the point of being objectionable to the operator; or they were relatively quiet but developed less than the desired vacuum or pressure.

Anyone who has heard a vacuum cleaner in operation, even of the domestic type, appreciates that the intake and discharge of air from the blower creates considerable noise. It is surprising to discover that nearly half the noise is generated by the electric motor, particularly the cooling air flow for the motor, and that to have a relatively quiet vacuum cleaner-blower assembly the noise generated by both the blower and motor must be reduced.

SUMMARY OF THE INVENTION

In the vacuum cleaner-blower assembly of the present invention, noise emission from the motor is substantially reduced by providing for improved cooling air flow; specifically by providing an axial flow cooling air fan, cooling air inlet and discharge means arranged in the motor housing to minimize generation and emission of noise, and sound absorbing means against which the axially directed flow of cooling air is impinged before exiting through the air discharge means.

The quiet operating motor is in turn coupled to and drives a quiet operating, high efficiency blower, comprising an impeller having vanes with forward curved inducer portions and backward curved discharge portions. The impeller runs in a casing or scroll which has a chamber receiving the discharge air from the impeller that linearly increases in cross-sectional area as air moves about the periphery of the impeller. The blower may be used in conjunction with stationary guide means or blades for guiding the air flow into the inducer portion of the impeller to further increase performance without creating noise or increased power consumption.

Thus, the vacuum cleaner-blower assembly of the present invention results in quieter operation and increased performance as compared to prior art units of this type.

Other objects and advantages of the invention will become apparent as the description proceeds.

DESCRIPTION OF THE PREFERRED EMBODIMENT

Figure 2:
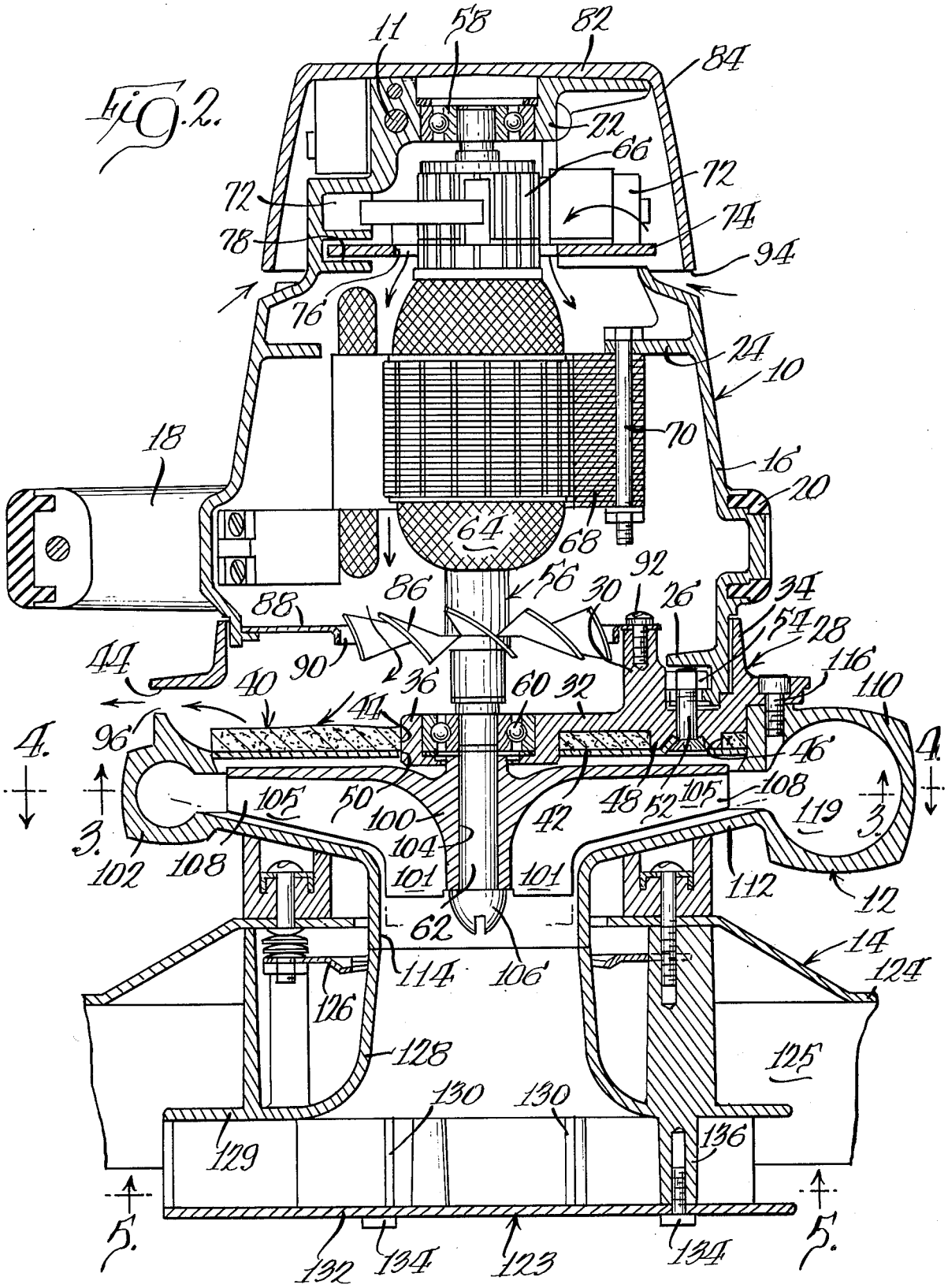
FIG. 2 is a vertical cross-sectional view of the vacuum cleaner-blower assembly, the view being taken substantially along and in the direction of line 2—2 of FIG. 3.
Figure 4:
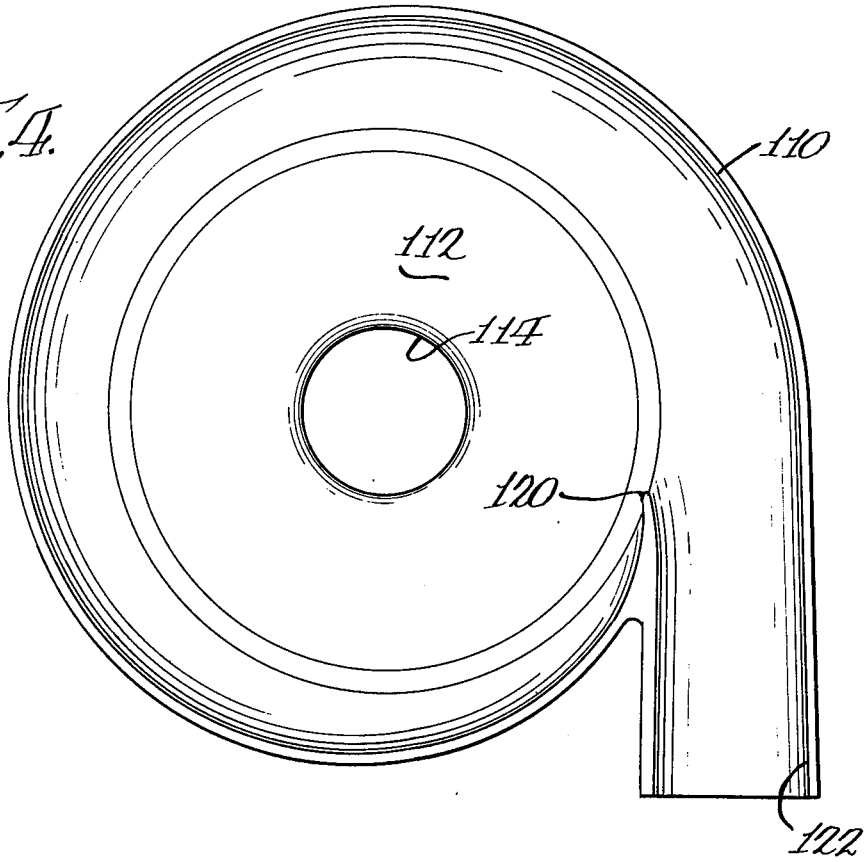
FIG. 4 is a horizontal cross-sectional view taken substantially along line 4—4 of FIG. 2, and showing the blower casing.

Referring to FIG. 2, the vacuum cleaner-blower assembly of the present invention comprises a motor 10 secured to a blower 12 which in turn may be secured or mounted on other devices, such as the tank type vacuum cleaner cover 14.

The motor 10 includes two vertical housing halves 16 joined together by fasteners 11 to form a cup-shaped closure open at one end (the bottom in FIG. 2). The halves 16 have extending portions 18 which form a pair of handles for the assembly and which carry an electric switch and cord (both not shown) for the motor. The outer perimeter of the handles and the two housing halves is encircled by a rubber molding 20. The halves 16 have internal web structures, such as those indicated at 22 and 24, for purposes hereinafter described, and a bottom flange 26 to which a cover plate assembly 28 is secured to close the open end of the motor housing.

The cover plate assembly 28 includes a cast wheel-like member 30 having a plurality of generally radially extending arms or spokes 32, joining an outer annular wall portion 34 to a central hub portion 36. The arms 32 are designed to leave as much open space therebetween as possible, consistent with strength requirements. Generally, the open space between the arms is 60 percent or more of the total area of the open lower end of the housing.

The cover plate assembly 28 also includes sound absorbing material or means 40, the use of which will be hereinafter described, and a sheet metal disc 42 for supporting the sound absorbing material 40 and closing off the space between the arms 32 of the member 30. The sound absorbing material 40 is preferably an annular disc of fiberglass material or matting having an opening 44 for the hub portion 36 and several peripheral openings 46 for feet or pads 48 formed on the arms 32. The sound absorbing material 40 is located between, but not substantially compressed by, the arms 32 of the member 30 and disc 42. Like the sound absorbing material, the disc 42 has a central opening 50 for receiving the hub 36 and peripheral openings for receiving fasteners 52 which secure the disc 42 against the pads 48 of the member 30 and in turn secure the member 30 to the flange 26; nuts 54 for the fasteners 52 being carried in slots formed in the flange 26.

The motor 10 has an output shaft 56 which rotates on a pair of bearings 58 and 60 carried in bores formed in the web 22 and cover plate assembly 28, respectively. One end 62 of the shaft 56 extends out beyond the cover plate assembly 28 to drive the blower 12, as will be hereinafter described. The shaft 56 also carries a rotor winding 64 and a commutator 66, the rotor winding cooperating with stator laminations or winding 68 secured by fasteners 70 to the web 24 of the housing 16.

A pair of brush assemblies 72 cooperate with the commutator 66 and are secured to an insulated member 74 having an opening 76 therein for the commutator and held in place in notches or grooves 78 formed in the housing halves 16. The brush assemblies 72 are covered by a snap-on cap 82 which has a top wall and a tapering side wall 84. The cap acts as a dust shield and also serves to muffle or contain the brush-commutator noise.

For cooling the motor 10, a plural blade axial fan 86 is carried intermediate the ends of shaft 22, preferably just below the motor armature or rotor 64. To increase the efficiency of the fan, it rotates within a baffle 88 having a downwardly turned lipped opening 90 for guiding and enhancing the air flow; the baffle being secured, as by fasteners 92, to the motor housing. The axial blade fan 86 is quieter than the centrifugal fans heretofore used and contributes to the overall quiet operation of the motor assembly of this invention.

Cooling air enters the motor 10 through inlet means or opening 94 provided between the edge of the side wall 84 of the cap 82 and the upper edge (as shown in FIG. 2) of the housing halves 16. The inlet opening 94 is a relatively long slot encompassing substantially the entire periphery of the housing to reduce the velocity of the intake air and minimize noise generated thereby. Unlike prior devices, wherein the air inlets are directly in line with the commutator and the brush assemblies and permit transmission of the noise generated by the brushes, the air inlet opening 94 is spaced laterally outward and axially downward from the brush assemblies 72 so as to contain and muffle brush noise within the motor housing, particularly the cap 82. Air is thus pulled upwardly and inwardly over the brush assemblies 72 and the commutator 66. The air then flows down through the opening 76 in the support 74 and flows between the rotor 64 and stator 68 of the motor to cool the windings thereof. The air is then impelled through the fan 86 and the opening 90 in the baffle 88. The fan 86 forces the air to impinge perpendicularly against the sound absorbing material 40 located at the bottom end of the motor housing to muffle any noise being transmitted by the air stream. The air flow then is turned 90° and exits through discharge means or opening 96 defined between the margins of the housing 16 and the blower 12. Like the inlet means 94, the outlet means 96 is a relatively long slot encompassing almost the entire periphery of the housing to reduce the velocity and thus the noise of the air exiting from the motor.

The above-described improvements in cooling air flow have the cumulative effect of cutting the noise generated by cooling air in half, as compared to prior art blowers of similar capacity. The composite improvements in motor construction substantially reduce overall motor noise and increase motor performance.

Figure 3:
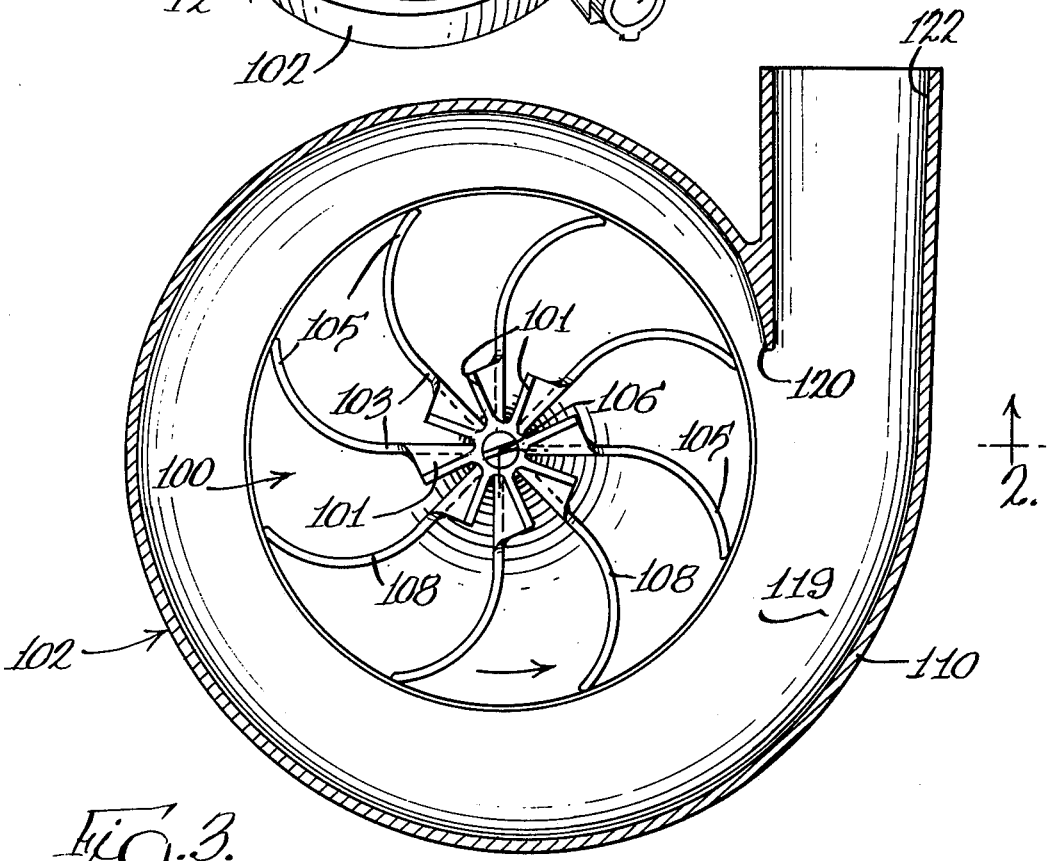
FIG. 3 is a horizontal cross-sectional view taken substantially along line 3—3 of FIG. 2, the view showing the blower impeller and its discharge chamber or scroll.

The blower 12 comprises a fan or impeller 100 and a scroll or casing 102 containing the impeller. The impeller 100 is a disc-like member having a center hub 104 which receives the end 62 of the shaft 56 and is held thereon by a threaded fastener 106. The other end of the hub 104 abuts the inner race of the bearing 60 to axially locate the impeller on the shaft. As better shown in FIG. 3, the impeller 100 comprises a plurality of vanes 108 each having a central inducer portion 101 (wherein the vane is curved forwardly in the direction of rotation), an intermediate transistional portion 103, and a peripheral or tip portion 105 (wherein the vane is curved rearwardly relative to the direction of rotation). As shown in FIG. 2, the inducer portions 101 of the vanes protrude axially beyond the peripheral portions 105, and the peripheral portions are of progressively decreasing height from adjacent the inducer portions to the periphery thereof. In this construction, the forward curvature of the inducer portions 101 and the rearward curvature of the tip portions 105 increases the efficiency of the impeller and reduces or eliminates shock and noise generation, resulting in quiet operation of the impeller.

The blower casing 102 comprises a helical exhaust chamber 110 circumscribing the outer ends of the vanes 108, an inclined lower wall portion 112 conforming to and enclosing the peripheral portions 105 of the vanes, and a central tubular inlet chamber 114 circumscribing the axially extending inducer portions 101 of the vanes. The top wall of the exhaust chamber 110 is provided with circumfrentially spaced threaded openings for receiving fasteners 116 to secure the casing 102 to the cover plate assembly 28 of the motor 10. The exhaust chamber 110 constitutes a volute chamber 119 which, from a reference point denoted at 120 in FIG. 3, progressively increases in size both radially and axially about an arc of 360° to a tangential discharge outlet 122 contiguous to the reference 120. The increase in dimensions is such to provide a linear increase in the cross-sectional area for air flow as the air moves counterclockwise (as viewed in FIG. 3) from the reference 120 to the outlet 122. The linear increase in the cross-sectional area of the chamber and its arcuate shape convert the dynamic pressure of the fluid discharged from the impeller to an essentially static pressure and accommodate the progressively increasing quantity of air coming from the impeller as a given point on the impeller moves from the starting reference 120 to the tangential outlet 122. Consequently, air from the impeller enters the volute chamber without turbulence and thus with minimal noise. Therefore, the volute chamber increases the efficiency of the blower, reduces noise, and results in increased air flow with less power than would theoretically be expected.

Figure 1:
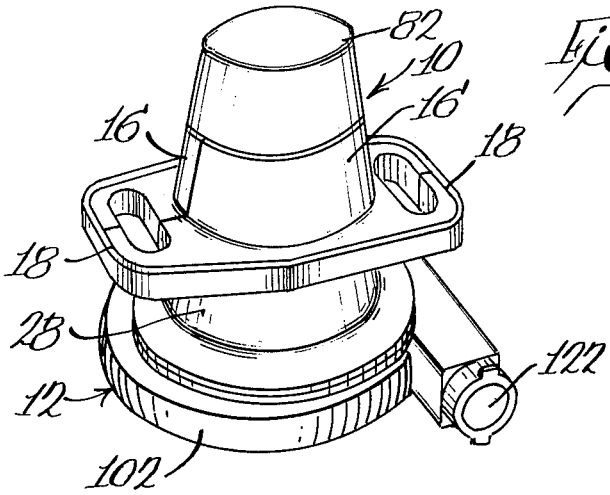
FIG. 1 is a perspective view of a vacuum cleaner-blower assembly constructed in accordance with the invention.

As thus constructed, the basic vacuum cleaner-blower assembly 10–12 is very compact and capable of being embodied in highly esthetic designs such for example as that shown in FIG. 1. The handles 18 impart particular portability and convenience of use to the assembly. Moreover, the assembly is effected with particular ease and economy since the housing means for all of the mechanical and electrical components is comprised of only five readily assembled parts, namely, the two housing halves 16, the removable cap 82, the cover plate assembly 28, and the blower casing or scroll 102. Thus, the invention provides compact, economical and highly efficient vacuum cleaner-blower assembly.

Figure 5:
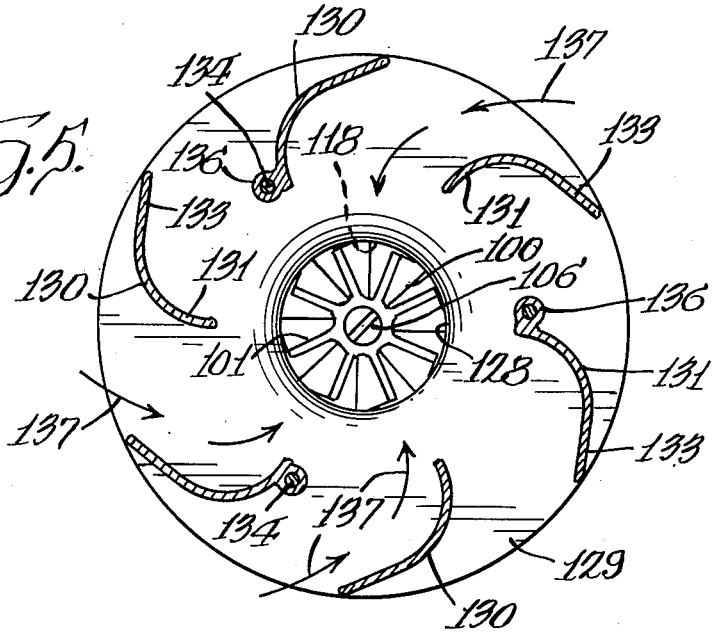
FIG. 5 is a horizontal cross-sectional view taken substantially along line 5—5 of FIG. 2 showing stationary guide means for the impeller inlet.

For further increasing performance, without substantially increasing either noise generation or power consumption (or for the same performance with reduced noise generation and power consumption), the vacuum cleaner-blower assembly may be used with stationary guide means 123 shown in FIGS. 2 and 5. The guide means 123 here shown is incorporated into a tank cover 14 which can be fitted onto a standard container, such as a 55 gallon drum, to convert the drum into a vacuum cleaner receptacle to hold the debris collected by the vacuum cleaner. The cover 14 includes a top wall 124 and a rim 125 for sealed engagement with the container, a hose connection (not shown) for reception of a vacuum cleaner hose, and quick connect and release connections 126 which cooperate with corresponding portions on the tubular inlet 114 of the blower casing for detachably mounting the vacuum cleaner-blower assembly on the tank cover 14. The tank cover 14 has a tubular portion 128 which at one end mates with the tubular inlet 114 and at the other end widens out into a bell mouth and an annular guide mounting plate 129.

As shown in FIGS. 2 and 5, the stationary guide means 123 comprises the plate 129, a plurality of stationary guide vanes or blades 130 mounted on the plate 129, and a bottom closure plate 132 secured in spaced relation to the plate 129 by fasteners 134, whereby to define a peripherally open circular or annular chamber containing the blades 130. The blades 130 each have an inner arcuate portion 131 and a generally tangential outer portion 133, the composite curvature of which is such as to conduct air from the periphery of the chamber into the impeller inlet 114 in a flow path complementary to the forwardly curved inducer portions 101 of the impeller. Thus, as indicated by the arrows 137, the blades 130 enhance the flow of air to the impeller and cause the same to act as a multiple stage compressor for increasing vacuum performance.

The apparatus above described is adapted to performance of several functions in residential, commercial and industrial applications. The cover 14 may be sealingly secured to or mounted on any desired size of canister, either stationary or portable, and the vacuum-blower assembly may be detachably secured to the cover to provide a highly efficient and effective multiple stage vacuum cleaner, either wet or dry. The vacuum-blower assembly may be removed from the cover and a vacuum cleaner bag, filter and hose assembly may be detachably secured to the inlet 114 whereby to provide a light weight and readily portable vacuum cleaner; the handles 18 contributing to portability. Also, the bag may be removed from the inlet and a blower hose and nozzle may be detachably secured to the outlet 122 whereby to convert the unit to a highly portable blower. In the latter uses, a strap or harness may be attached to the handles 18 so that the unit may be carried on the user's back or shoulders to free both hands for performance of cleaning functions.

In use, with electricity supplied to the motor and the shaft 56 rotating, the motor fan 86 induces a highly efficient yet quiet flow of cooling air over the brushes, the commutator, the stator and the rotor of the motor to provide for efficient motor operation. At the same time, the motor drives the impeller 100 to provide large volume, efficient flow of air through the blower to create a substantial vacuum force at the inlet 114 and a usable blower force at the outlet 122. When used with the cover 114 and the guide assembly 123, the vacuum force is further enhanced.

In specific examples of the improvements provided by this invention, an earlier model of classic design of a so-called 2 horsepower motor unit generated 1.2 H.P., a vacuum force of 7.4 inches of water, and an air flow of 144 CFM, at a noise level of 92–93 dba. With the same motor embodied in the construction of the present invention, the unit generated 1.4 H.P., a vacuum force of 12 inches of water, and an air flow of 184 CFM, at a noise level of only 86.5 dba. Similarly, an earlier model of classic design of a so-called 1.5 H.P. motor unit generated 0.76 H.P., a vacuum force of 5 inches of water and an air flow of 118 CFM; while the same motor in the construction of this invention produced 0.92 H.P., a vacuum force of 8.5 inches of water, and an air flow of 155 CFM. Again, the noise level was reduced by 5.5 to 6.5 dba to bring the noise level well below that which is deemed critical.

While we have illustrated and described what we regard to be the preferred embodiment of our vacuum cleaner-blower assembly, it will be understood that modifications, variations and changes may be made therein without departing from the scope of the invention, as defined by the appended claims.

What is claimed is:

1. A vacuum cleaner-blower assembly comprising, in combination, an electric motor having a commutator assembly adjacent one end and an output shaft at its other end, a housing for said motor enclosing said commutator assembly and having elongate inlet slots on the periphery of said housing for admission of air to said housing, an axial vane cooling fan on said output shaft within said housing, sound absorbing material consisting solely of a disc shaped mat juxtaposed in the discharge flow from said axial cooling fan and normal to said shaft, said housing having elongate outlet slots on the periphery of said housing and located radially outwardly of said mat, said fan drawing cooling air inwardly through said inlet slots, over said commutator assembly and over and through the motor, impinging the air generally perpendicularly against said sound absorbing mat and discharging the air outwardly through said outlet slots; an impeller on said output shaft outwardly of said motor housing, a casing and a support disc enclosing said impeller, said casing being connected to said motor housing, said sound absorbing material lying against said support disc, said sound absorbing material having an opening for said output shaft, said support disc supporting said sound absorbing material and being located adjacent said impeller, said impeller comprising a plurality of curved vanes facing radially and axially away from said motor and each comprising an inner portion curved forwardly in the direction of impeller rotation and an outer or tip portion curved rearwardly relative to the direction of impeller rotation, said inner portions projecting axially beyond said tip portions in the direction away from said motor, said casing including a tubular inlet chamber surrounding the axially extending portions of the inner portions of said vanes, a generally transverse wall paralleling and enclosing the tip portions of said vanes and an exhaust chamber surrounding the outer periphery of said vanes, said exhaust chamber comprising a volute chamber of linearly increasing cross-sectional area leading to a generally tangential outlet; said impeller upon energization of said motor rotating within said casing to draw fluid at high vacuum pressure axially into said tubular inlet chamber, to discharge the fluid without turbulence radially into said volute chamber and to discharge the fluid through said tangential outlet; whereby the assembly provides a vacuum connection at said tubular inlet chamber and a blower connection at said tangential outlet and produces substantial fluid force and volume of flow with minimal cooling fan and impeller noise and power consumption.

2. The vacuum cleaner-blower assembly of claim 1, further comprising inlet guide means incorporated into a canister cover, said vacuum cleaner-blower assembly being adopted to be attached to and detached from said cover, said cover being adopted to close a canister to form a debris container for a vacuum cleaner, said guide means being adopted to be connected to said tubular inlet chamber and comprising a peripherally open chamber having guides plates therein, each guide plate being curved to provide an inner arcuate portion and a tangential outer portion to cause air flow complementary to the inner portions of the impeller vanes.

3. In a vacuum cleaner-blower assembly including a blower having a casing and impeller, and an electric motor having a commutator at one end and an output shaft at the other, the improvement comprising a housing for the motor having inlet slots in the peripheral wall thereof adjacent the commutator assembly for admitting cooling air into said housing adjacent said one end of said motor and having outlet slots in the peripheral wall thereof surrounding said shaft for discharging cooling air from said housing at the other end of said motor, an axial flow fan on said shaft adjacent said outlet slots for cooling said motor, and sound absorbing means consisting solely of a disc shaped mat located within said housing, juxtaposed parallel to and downstream of said fan and adjacent said outlet slots, said sound absorbing means having an opening therein for receiving said output shaft, said sound absorbing means lying against and being supported by one of said housing and casing, whereby air is drawn by said fan laterally into said housing through said inlet slots, over the commutator assembly and over and through the motor, impinged axially and normally against said sound absorbing means, and then discharged laterally through said outlet slots.

4. The improvement of claim 3, wherein said sound absorbing means is made of fiberglass and disposed perpendicular to the axis of said shaft.

5. In a vacuum cleaner-blower assembly as set forth in claim 3, further comprising inlet guide means for said blower and including a peripherally open chamber having a plurality of guides plates therein curved to cause air flow complementary to the impeller.

6. In a vacuum cleaner-blower assembly as set forth in claim 5, wherein said inlet guide means are incorporated into a canister cover, said vacuum cleaner-blower assembly being adapted to be attached to and detached from said cover, said cover being adapted to close a canister to form a debris container for the vacuum cleaner.

7. In a vacuum cleaner-blower assembly as set forth in claim 6, wherein each of said inlet guide plates comprises an outer tangential portion for directing air flow from the canister to the guide plate, and an inner arcuate portion for directing air flow from the guide plate to the impeller.

* * * * *